United States Patent [19]

Dunston

[11] 4,060,240

[45] Nov. 29, 1977

[54] PUSH PULL EXERCISING DEVICE

[76] Inventor: Virgil M. Dunston, 1408 SW. Donovan, Seattle, Wash. 98106

[21] Appl. No.: 677,915

[22] Filed: Apr. 19, 1976

[51] Int. Cl.[2] ..... A63B 21/00

[52] U.S. Cl. ..... 272/126; 272/900

[58] Field of Search ..... 272/116, 132, 143, 125, 272/128, 133, 126, 136, 900; 24/115 H, 115 L, 115 M, 115 J, 115 F, 115 R, 136 A

[56] References Cited

U.S. PATENT DOCUMENTS

| | | | |
|---|---|---|---|
| 2,148,590 | 2/1939 | Tamarin | 24/136 A |
| 3,608,900 | 9/1971 | Welch | 272/133 |
| 3,752,474 | 8/1973 | Macabet et al. | 272/126 |
| 3,843,119 | 10/1974 | Davis | 272/125 |

FOREIGN PATENT DOCUMENTS

| | | | |
|---|---|---|---|
| 1,421,162 | 11/1965 | France | 272/900 |

*Primary Examiner*—William H. Grieb
*Assistant Examiner*—William R. Browne

[57] ABSTRACT

This portable exerciser device includes a cross strap with enlarged end portions, a central portion of the cross strap may be stood on or disposed between a door and its adjacent, supporting post. The enlarged end portions will prevent sliding movement of the cross strap by engagement of such enlarged end portions with the outside edges of the shoes of the party standing on the central cross strap portion or engagement thereof by the juncture between the door and its adjacent, supporting post. A pulley is connected with the central portion of the cross strap. A cord is connected with a first handle-stirrup, thence reeved about the pulley and thence connected with a cord connector and at a location intermediate the length of the cord. The cord connector is connected with a second handle-stirrup. The connection between the cord connector and the cord is characterized by free sliding movement during one direction of relative travel therebetween and releasable, positive stop, connection during relative travel in the other direction. A form of such connector includes a ball check cooperating with the tapered conical enclosure.

2 Claims, 6 Drawing Figures

PUSH PULL EXERCISING DEVICE

BACKGROUND OF THE INVENTION

There are a number of prior patented portable exercising devices and those known to the applicant are the following U.S. Pat. Nos.

1,610,324
2,832,595
3,843,119

Also, there are many similar portable devices on the market and which are not the subject matter of existing patents. All of these portable devices, patented and nonpatented, are designed to employ as the anchor means, a doorknob, a bed post, or the like. Thus, most vigorous exercises cannot be performed with these devices because of the relative fragile nature of the anchor means. Also, the number and nature of the exercises that may be practiced with these prior art devices are necessarily limited as the body positions that may be assumed when the exerciser is so anchored to a doorknob or a bedstead, are inherently limited and cannot include all of the following: standing, bending, kneeling, crouched, sitting, and lying prone or supine.

SUMMARY OF THE INVENTION

This invention provides a portable device which permits all of the known exercises where a rope is connected between a person's hands or between a person's feet, regardless of the vigorous nature thereof or the required posture position of the body of the person doing the exercises. In general, this portable exerciser provides a cross strap with enlarged end portions. The central portion of this cross strap may be stood on by a person and obviously one cannot "lift himself by his own boot straps" and thus may not be any exercise lift his body off the strap on which he is standing. Thus, the thrust of the lift can only tend to slide the cross strap sidewise relative to the exerciser's shoes. The enlarged end portions of the cross strap prevent the slipping of the cross strap out from under one's shoes. Also, the cross strap may be anchored between a closed door and its adjacent, supporting post and at different elevations thereof. When the enlarged strap end portions are on one side of the door-post combination and the pull is on the other side thereof, the enlarged, cross strap, end portions will prevent sliding movement of the cross strap. This exerciser also has novel means for adjusting the cord length between the anchored cross strap and the handle-stirrup, engagable by one's hands or one's feet, to permit the required cord length regardless of the selected exercise employing this exerciser.

The above-mentioned general objects of my invention, together with others explicit or implicit in the same, will now appear as the description of my invention proceeds in connection with the accompanying drawings, wherein like reference numerals refer to like parts and wherein.

DETAILED DESCRIPTION OF A PREFERRED EMBODIMENT

Figures 1, 2, 3, 4, 5, 6:
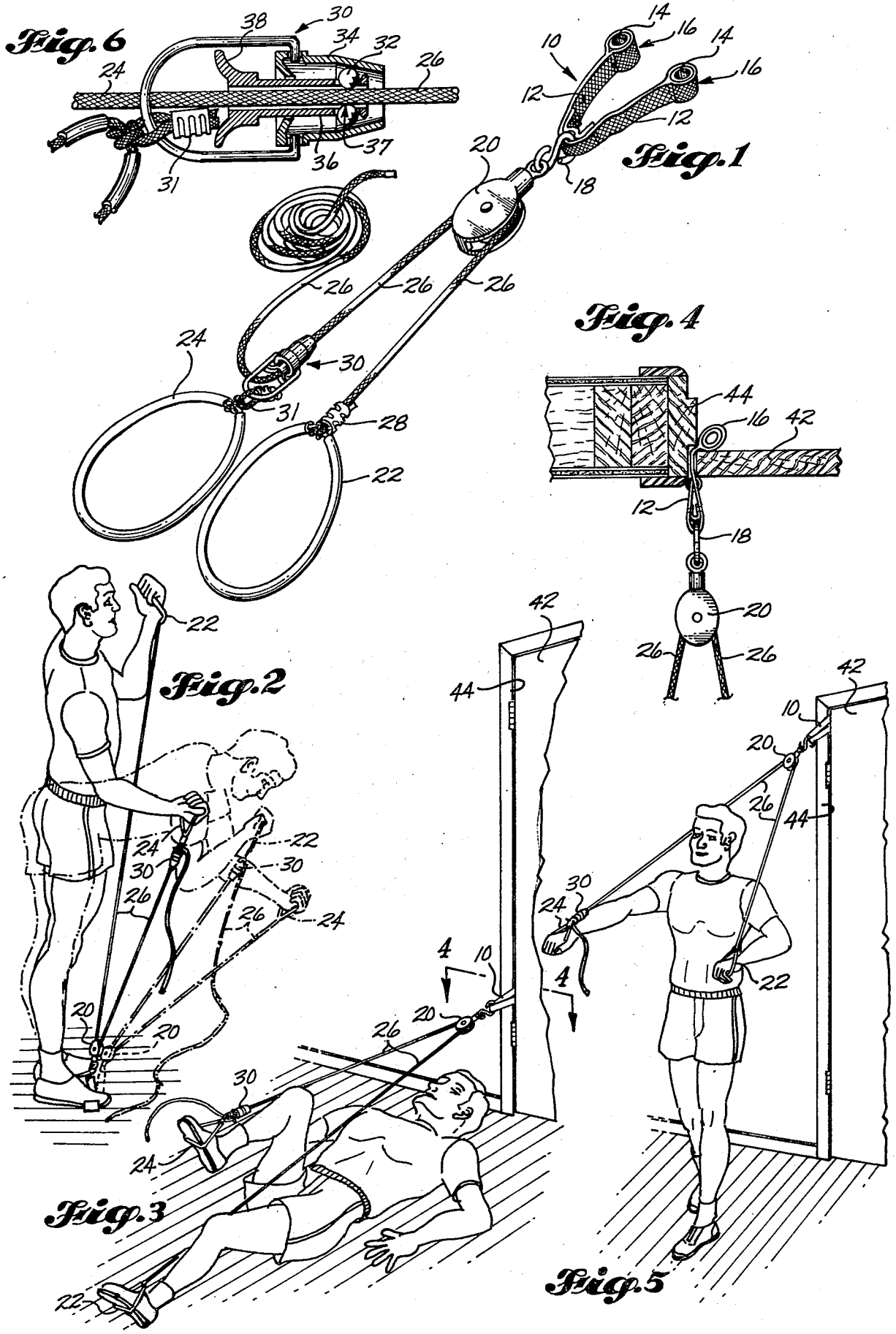
FIG. 1 is a perspective view of a portable exerciser of my invention.
FIG. 2 is a side view showing my device being used by a person standing on the cross strap and showing in full lines, an exercise that may be performed by a person standing upright, and showing by dash lines my device being used by a person bent over at the waist with an angle of approximately 90° between the hips and the waist.
FIG. 3 shows the cross strap of my invention anchored between a door and its adjacent, supporting post and at a lower level thereof and with a person lying on his back and engaging in leg exercises.
FIG. 4 is a fragmentary sectional view taken substantially on broken line 4—4 of FIG. 3 to illustrate the anchoring of the cross strap to the juncture between the door and its adjacent, supporting post.
FIG. 5 is a view showing the cross strap again anchored between a door and its adjacent, supporting post but at a higher level thereof and with a person standing and engaging in arm and shoulder exercises.
FIG. 6 is an enlarged sectional view of the cord connector means releasably connecting the second handle-stirrup to the cord.

The cross strap 10 (see particularly FIG. 1) comprises a central portion 12 and may be fabricated from two layers of "Nylon" strap material to provide the desired strength and with suitable dimensions. Two layers may be sewn together to provide loops at both end portions to snugly enclose therein short pieces of polyvinyl tubing 14. Thus, the cross strap is provided with enlarged end portions which are generally numbered 16.

The cross strap 10 is detachably connected by S-shaped pulley connector means 18 to pulley 20. First and second handle-stirrup means 22 and 24, which may be grasped by the hands or engaged by the feet of a user, are indicated by flexible loops. A cord 26 is formed of material having suitable strength with a minimum of bulk, such as 3/16 inch solid braid "Nylon" rope, to provide for the desired long life, strength, and appearance. This cord 26 has one end portion thereof connected to first handle-stirrup 22, as by metallic connector 28, is reeved about the roller of pulley 20, and is thence connected at a mid-portion thereof to a cord connector means, generally numbered 30 and shown in section in FIG. 6 of the drawings. Cord connector means 30 is connected with the second handle-stirrup means 24 by a connector means 31.

This cord connector means 30 comprises three metallic balls 32, a conical chamber 34 for said balls, and a stem 36 having ball cup recesses 37 therein and carrying a release handle 38. The cord 26 passes between the three balls 32 in a conical chamber 34. When the cord 26 is moved toward the right as respects FIG. 6 of the drawings and moves relative to the cord connector 30, the balls 32 and the cord 26 move together toward the smaller diameter of the conical chamber 34 and the rope 26 and the connector means 30 move together until the balls 32 and the cord 26 jam and then the cord connector means 32 and the cord 26 thereafter move together as a unit. However, if the cord 26 is moved to the left as respects the showing in FIG. 6 and as respects the cord connector 30, the rope moves freely, relative to and as respects the balls 32 and as respects the cord connector means 30. There will be sufficient length to the cord 26 so that the length between the pulley 20 and the first and second handle-stirrup means 22 and 24 will permit an adjusted length of cord therebetween consistent with the particular exercise to be performed--all of which will be explained later with respect to particular figures. When it is desired to provide less cord between the first and second handle-stirrups 22 and 24 and the pulley 20, cord 26 may be readily and freely pulled past the cord connector means 30. When it is desired to provide more cord between the first and second handle-strip means 22, 24 and the pulley 20, then the release handle 38 can be pulled to move the balls away from the smaller diameters of the conical chamber 34 and the desired amount of rope can be pulled to the right as respects FIG. 6 of the drawings, or, in other words, provide more rope between the handle-stirrups 22, 24 and the pulley 20.

All exercises on devices of this invention require a pull or push by a foot or a hand and a counter pressure by the opposite foot or hand and include isometric as well as isotonic exercises.

Now referring to FIG. 2, the cross strap 10 is placed flat on the floor and the shoes 40 of a wearer are placed thereon with the enlarged end portions 16 on each of the outer sides of such shoes 40. Then the amount of cord 26 between the pulley 20 and the first and second handle-stirrups 22, 24 is adjusted depending upon whether it is desired to enter into exercises of the type where a party is standing (requiring more rope as is shown by full lines in FIG. 2) or it is desired to enter into exercises where the trunk of the body is bent at the waist (requiring less rope, as is illustrated by the dash lines shown in said FIG. 2).

More specifically, in connection with FIG. 2 of the drawings, the exercises illustrated in connection with the standing position (illustrated by full lines) is generally termed curling, simulating weight lifting. In the standing illustrated position, the arms of the party exercising are bent. However, if additional cord is provided between the handle-stirrups 22, 24 and pulley 20, an exercise may be performed with the arms projecting straighter from the body. If further additional cord is provided between the first and second handle-stirrup 22, 24 and pulley 20, then one hand can be extended fully over the top of one's head and exercises involving such position can be performed, such exercises are commonly called overhead lifts.

As respects the bent over position of the party exercising (shown in dash lines in FIG. 2) and with appropriate cord length, various exercises may be performed, including a modified "curl", as illustrated by the dash lines, or a pulling exercise may be readily executed, starting with one's hands at almost the floor level.

While all exercises that may be employed are not illustrated and described in connection with a standing or bent over position in connection with my device, some are illustrated and described and they indicate the need of a ready cord length adjustment between the first and second handle-stirrups 22 and 24 and the pulley 20 and the need of the adjustable cord connector means 30.

Another type of stable and readily available anchor means, which may be used in connection with my invention, is the juncture between a door and its adjacent, supporting post. In connection with FIGS. 3 and 4, the central portion 12 of the cross strap 10 is positioned between door 42 and the adjacent, supporting post 44 for said door 42. The enlarged end portions 16 are disposed vertically spaced apart, or with one above the other, and on one side of door 42, with the central portion 12 of cross strap 10 between the door 42 and the post 44, and with the balance of the exercising device extending to the opposite sides of the door 42 and post 44 from the side where the enlarged end portions 16 were disposed. The cross strap 10 is positioned in place when the door 42 is opened and then the door is closed. The device is positioned at a low elevation as illustrated in connection with FIG. 3 of the drawings or at a high elevation as indicated in connection with FIG. 5 of the drawings to permit different types of exercises.

In FIG. 3, the person exercising is lying supine and exercises that can be performed are exercises of the front and back of the legs as well as of the body.

In FIG. 5, the person exercising is standing as in FIG. 3, but the pulling action involved is generally downward and forward rather than generally upward, and often outward. In the standing position shown in FIG. 5 and with the exerciser device positioned high, as indicated, then exercises involving the shoulders and back of the arms can be readily employed. Also, with the exercise device in the same position as in FIG. 5, the person can kneel and in a kneeling position can perform pull-down exercises involving arms and shoulder muscles. In the kneeling pull-down position, it would be common for the party to be facing the door.

CONCLUSION

It will now be apparent that I have provided an exerciser device that is portable in that it can be held in place by one stepping on the central portion of cross strap 10 and the enlarged end portions 16 will prevent sliding movement of the strap 10 past one's shoes or the cross strap 10 may be anchored between a door 42 and the adjacent, supporting post 44 and the enlarged end portions 16 will prevent sliding movement of the cross strap 10 from such an anchor.

More specifically, I have provided a cross strap 10, having a central portion 12, and enlarged end portions 16, with the cross strap 10 connected by a pully connector means 18 to pulley means 20. The pulley connector means 18 is connected with a central portion of the cross strap 10. A cord connector means 30 is releasably connected with cord 26 providing means to readily adjust the amount of cord between first and second handle-stirrups 22, 24 and pulley 20 and thus readily provide the necessary length of cord 26 depending upon the exercise to be performed. The cord 26 is connected with first handle-stirrup 22, is then reeved about pulley 20, and is then connected with connector means 30 intermediate the length of cord 26. Then a connector means 31 is disposed between connector 30 and second handle-stirrup means 24.

The cross strap 10 is preferably formed from two layers of fabric and with loops formed at the ends thereof to snugly and frictionally engage and hold in place tubular pieces 14 to provide enlarged end portions 16 on cross strap 10.

Preferably, the connector means 18 is readily detachably connected between cross strap 10 and pulley 20 and this may be readily accomplished by providing a connector means 18 in the form of an S-shaped connector.

The cord connector means 30 is the type of connector, such as the ball check construction shown, so such connector means 30 is freely slidable on the cord 26 during one direction of travel therebetween and is releasably interconnected with the cord 26 during the other direction of relative travel therebetween. More particularly, the connector means 30 comprises balls 32 cooperating with a conical chamber 34 therefor.

The length of the cross strap 10, between enlarged end portions 16, is sufficient so that the shoes 40 of a wearer may rest on said cross strap 10 with the enlarged end portions 16 disposed outside the outside edge of the shoes 40 and closely adjacent thereto. Also, the central portion 12 of the cross strap 10 may be inserted between a door 42 and its adjacent, supporting port 44, when the door 42 is in open position and the door 42 then closed with the enlarged end portions 16, one above each other on one side of the door and with the remainder of the exerciser device on the other side of the door. Thus, the enlarged end portions 16 will resist sliding movement of the cross strap 10 relative to the door 42 and its adjacent post. 44.

Obviously, changes may be made in the dimensions, arrangements, and the forms of the parts of my invention without departing from the principles thereof, the above setting forth only a preferred form of embodiment of my invention.

I claim:

1. A portable exercising device comprising a flexible cross strap having a central portion of sufficient length to be retained by being stood on by a wearer of shoes or being placed between a door and its adjacent supporting post and having enlarged end portions positionable on the outside of said shoes or beyond a door and its adjacent support post to engage the same, said enlarged end portion resisting sliding movement of the cross strap when a tension is placed on a central portion thereof; pulley means for supporting a cable means; pulley connector means disposed between said pulley means and the central portion of said cross strap; a pair of cord connector means for connecting first and second stirrup means to a cable means; first and second handle-stirrup means for grasping by a user during an exercise program; cord means having one end portion thereof connected with said first handle-stirrup means, thence reeved about said pulley means, and thence releasably connected with one of said cord connector means at a location intermediate the cord means length and removed from its other end portion; said other of said cord means including an additional means to permit free sliding movement of said cord means when pulled in one direction and to automatically lock and stop the cord means in response to only pulling in the opposite direction of said cord means when said second handle stirrup means is held stationary.

2. The combination of claim 1, wherein said additional connector means and the cord means comprises a ball check means cooperating with a tapered conical enclosure means therefor.

* * * * *